US006446550B2

(12) United States Patent
Komata

(10) Patent No.: US 6,446,550 B2
(45) Date of Patent: Sep. 10, 2002

(54) SCREEN PRINTING MACHINE AND STENCIL SHEET ASSEMBLY

(75) Inventor: Satoru Komata, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 09/725,901

(22) Filed: Nov. 30, 2000

(30) Foreign Application Priority Data

Dec. 1, 1999 (JP) ..... 11-342241

(51) Int. Cl.[7] ..... B05C 17/08

(52) U.S. Cl. ..... 101/127; 101/127.1; 101/128.1; 160/378

(58) Field of Search ..... 101/128.1, 127, 101/127.1; 38/102.91, 102.2, 102.21; 112/103; 160/373, 374.1, 378

(56) References Cited

U.S. PATENT DOCUMENTS 6,095,068 A * 8/2000 Hori ..... 112/103

6,331,223 B1 * 12/2001 Wylie et al. ..... 156/160

FOREIGN PATENT DOCUMENTS

JP 8-052855 2/1996

* cited by examiner

*Primary Examiner*—Andrew H. Hirshfeld
*Assistant Examiner*—Kevin D. Williams
(74) *Attorney, Agent, or Firm*—Kanesaka & Takeuchi

(57) ABSTRACT

A screen printing machine including a stencil sheet assembly having a frame member having outer peripheral sides for partitioning an outer configuration and inner peripheral sides for partitioning an opening and stencil sheet adhered to one face of the frame member to cover the opening, a tension frame projected to inner sides of the inner peripheral sides of the frame member, having a raised portion raised toward the stencil sheet and arranged on other face of the frame member for applying tension to the stencil sheet, and holding means for holding the tension frame and the stencil sheet assembly which are put together such that a front face of the tension frame in a direction of raising the raised portion and the other face of the frame member are brought into contact with each other.

2 Claims, 16 Drawing Sheets

SCREEN PRINTING MACHINE AND STENCIL SHEET ASSEMBLY

BACKGROUND OF THE INVENTION

1. Field of the Invention

The present invention relates to a screen printing machine and a stencil sheet assembly used in squeegee printing.

2. Description of the Related Art

As shown in Japanese Patent Publication No. 21733/1994, a conventional simplified printing machine used in squeegee printing is provided with a base member installed with printed matter and a block frame attached to the base member such that an interval between the block frame and the base member is adjustable. Further, the block frame is detachably attached with a stencil sheet assembly constituted by extending stencil sheet on a frame member. In printing operation, printed matter is mounted at a predetermined position on the base member, ink is placed on the stencil sheet and the stencil sheet is pushed downwardly and squeegeed. Thereby, pertinent tension is applied to the stencil sheet, the stencil sheet applied with the tension is brought into contact with the printed matter, ink is transcribed onto the printed matter and an image is formed.

In the case of the above-described structure, the tension applied to the stencil sheet by the squeegeeing operation does not become constant as a number of times of use increases, and skilled technique is needed to continue applying the pertinent tension stably. Further, the apparatus is large-scaled and the structure is complicated.

Further, when the tension is applied to the stencil sheet of the stencil sheet assembly, there is a concern that there causes destruction by peeling off an adhering agent for adhering the stencil sheet and the frame member and applied tension becomes unstable.

It is an object of the present invention to provide a screen printing machine and a stencil sheet assembly capable of firmly applying constant tension to stencil sheet by a simple structure.

SUMMARY OF THE INVENTION

According to a first aspect of the present invention, there is provided a screen printing machine comprising a stencil sheet assembly having a frame member having outer peripheral sides for partitioning an outer configuration and inner peripheral sides for partitioning an opening and stencil sheet adhered to one face of the frame member to cover the opening. Further, there is provided a tension frame projected to inner sides of the inner peripheral sides of the frame member, having a raised portion raised toward the stencil sheet and arranged on other face of the frame member for applying tension to the stencil sheet. Further, there is provided holding means for holding the tension frame and the stencil sheet assembly which are put together such that a front face of the tension frame in a direction of raising the raised portion and the other face of the frame member are brought into contact with each other.

According to a second aspect of the present invention, there is provided the screen printing machine according to the first aspect, wherein at least one folding groove portion in parallel with the inner peripheral sides of the frame member is formed on the other face of the frame member.

According to a third aspect of the present invention, there is provided a stencil sheet assembly comprising a frame member having outer peripheral sides for partitioning an outer configuration and inner peripheral sides for partitioning an opening, stencil sheet adhered to one face of the frame member to cover the opening, and at least one folding groove portion formed on other face of the frame member and in parallel with the inner peripheral sides of the frame member.

According to a fourth aspect of the present invention, there is provided the stencil sheet assembly according to the third aspect wherein the frame member is a frame member substantially in a rectangular shape having four of the outer peripheral sides and four of the inner peripheral sides and the opening substantially in a rectangular shape, wherein the folding groove portion comprises four of folding groove portions formed along the four inner peripheral sides, and wherein four corners of the inner peripheral sides of the frame member are formed with cut-in portions reaching intersecting points of the folding groove portions orthogonally intersecting with each other and contiguous to each other.

DETAILED DESCRIPTION OF THE PREFERRED EMBODIMENTS

An explanation will be given of an embodiment of the present invention in reference to the drawings as follows.

Figure 1:
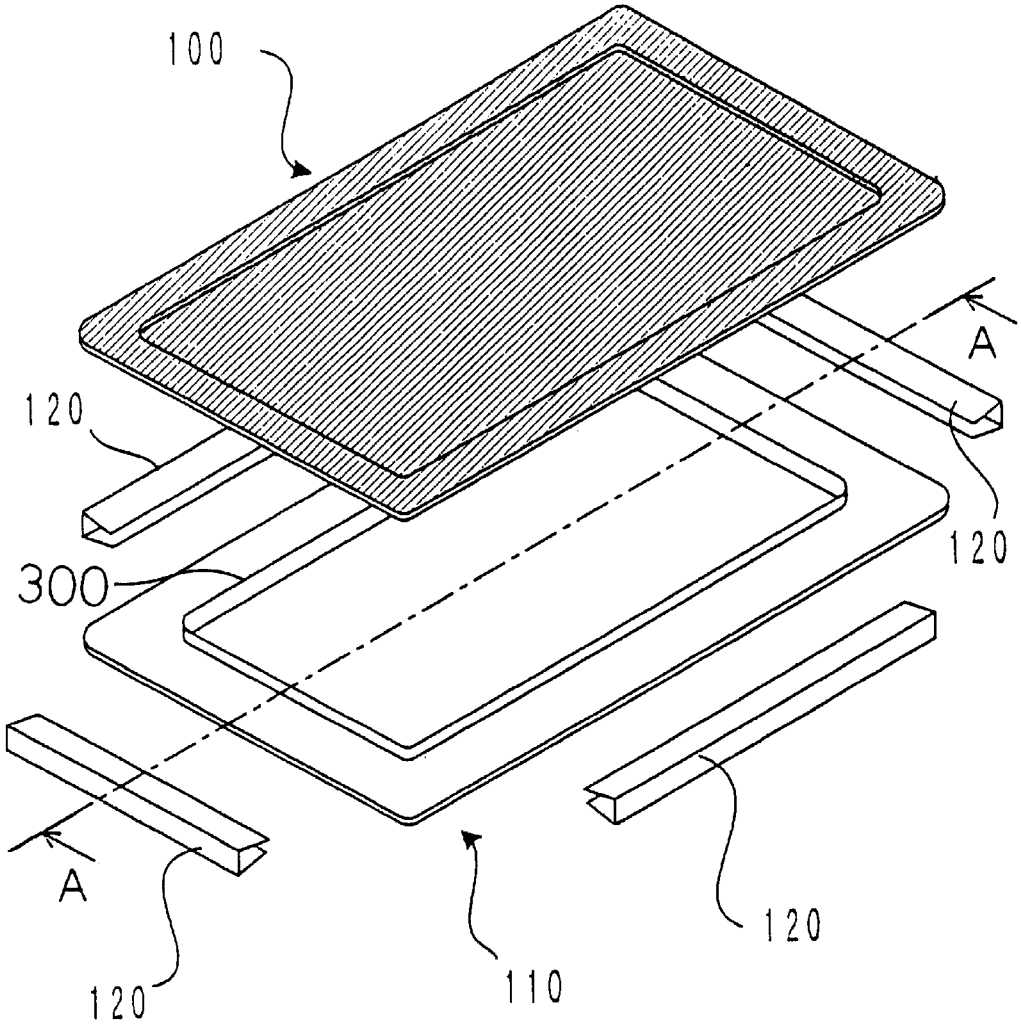
FIG. 1 is a perspective view showing to disassemble an embodiment of a screen printing machine according to the present invention.
Figure 2:
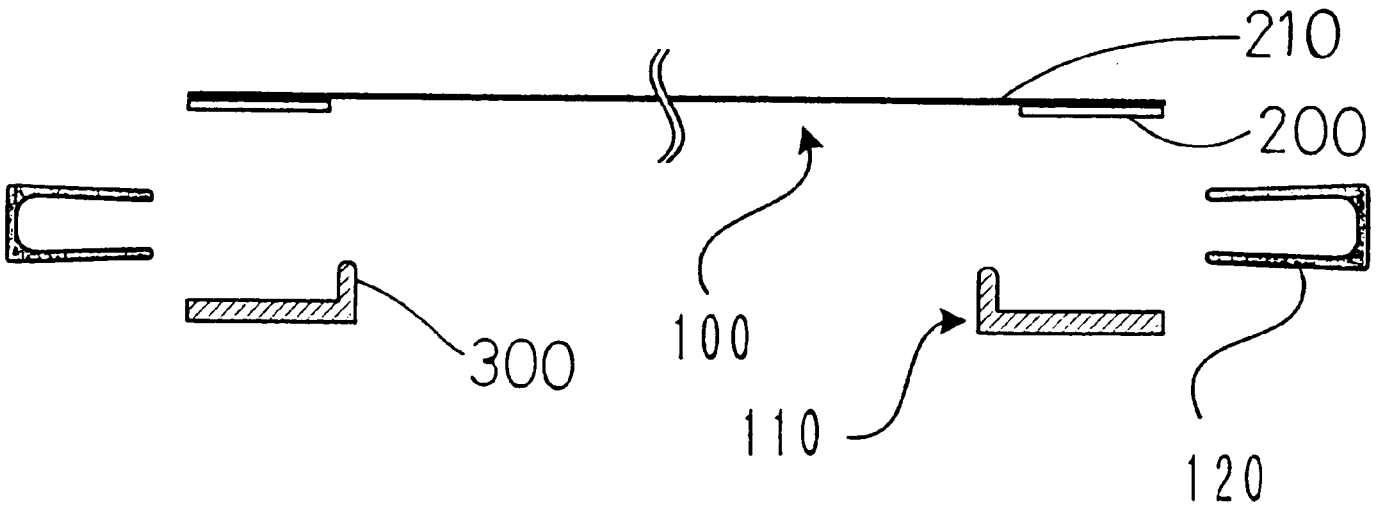
FIG. 2 is a sectional view taken along a section A—A illustrated in FIG. 1.
Figure 3:
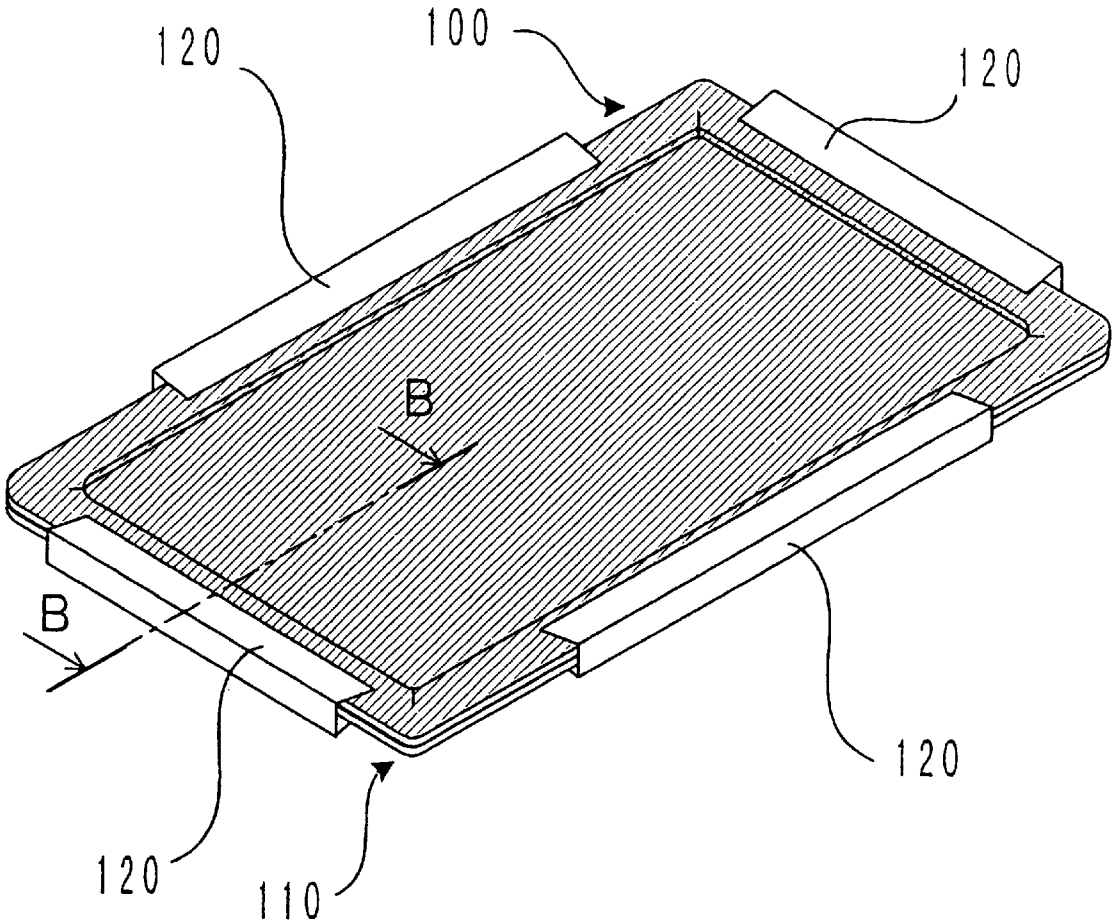
FIG. 3 is a perspective view showing the embodiment of the screen printing machine according to the present invention.
Figure 4:
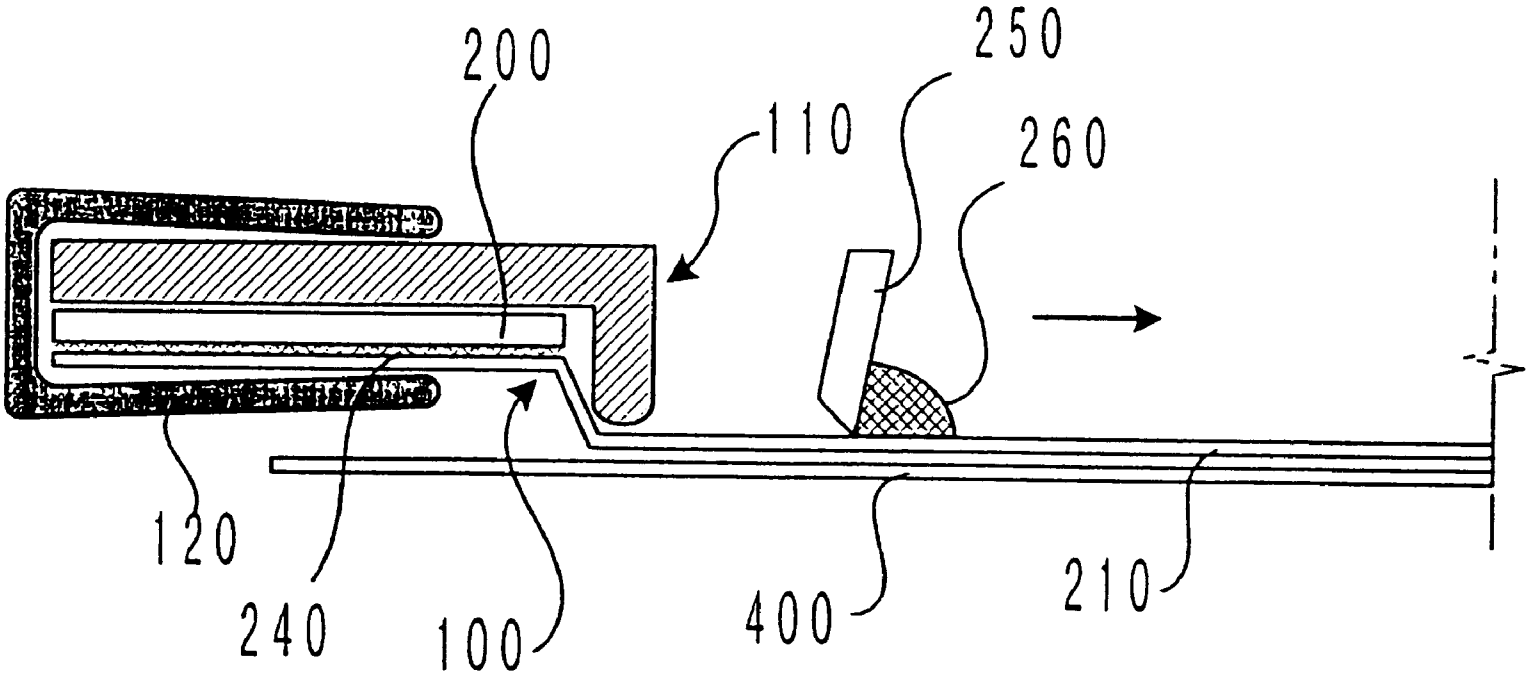
FIG. 4 is a sectional view taken along a cutting line B—B of FIG. 3.
Figure 5:
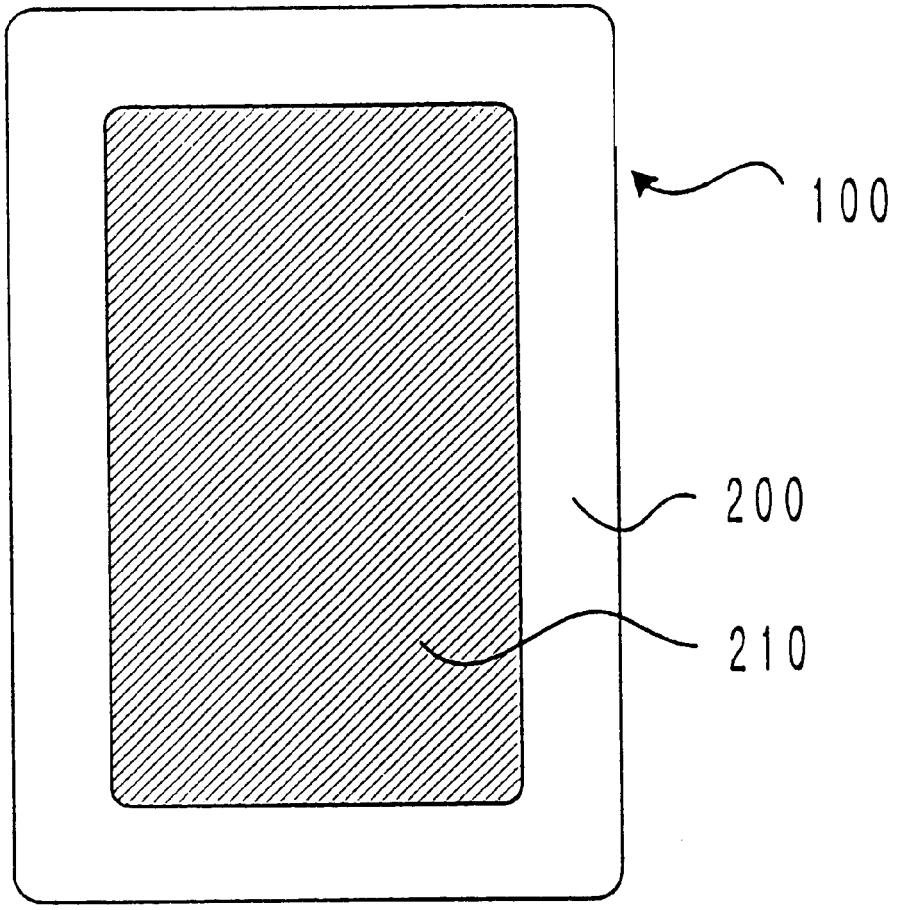
FIG. 5 is a plane view showing an embodiment of a stencil sheet assembly according to the present invention.
Figure 6:
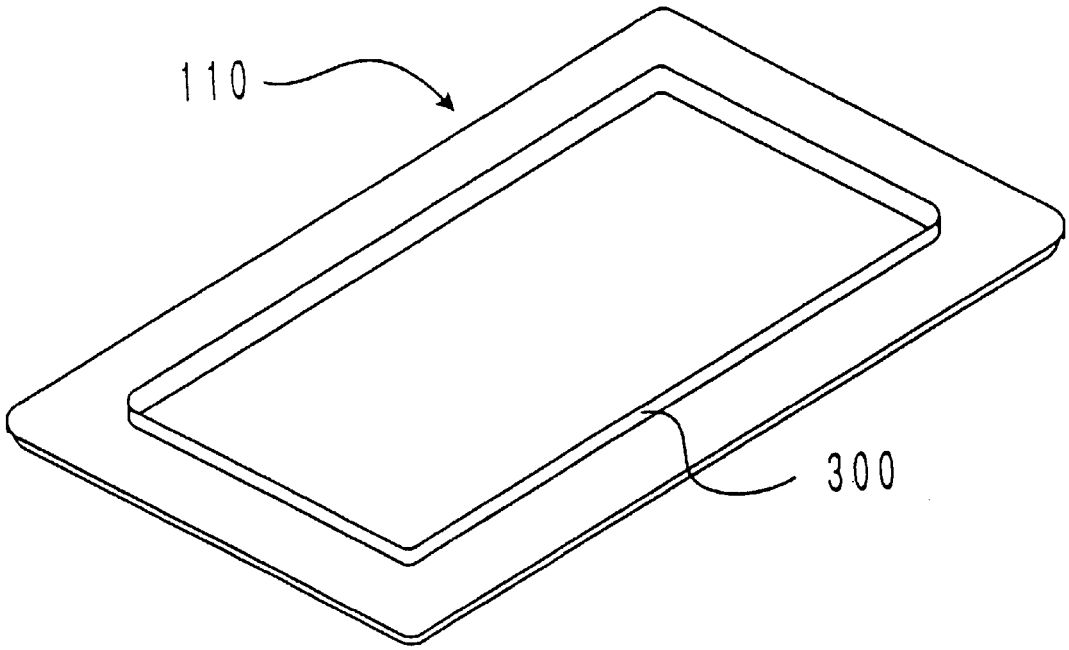
FIG. 6 is a perspective view showing an embodiment of a tension frame according to the present invention.
Figure 7:
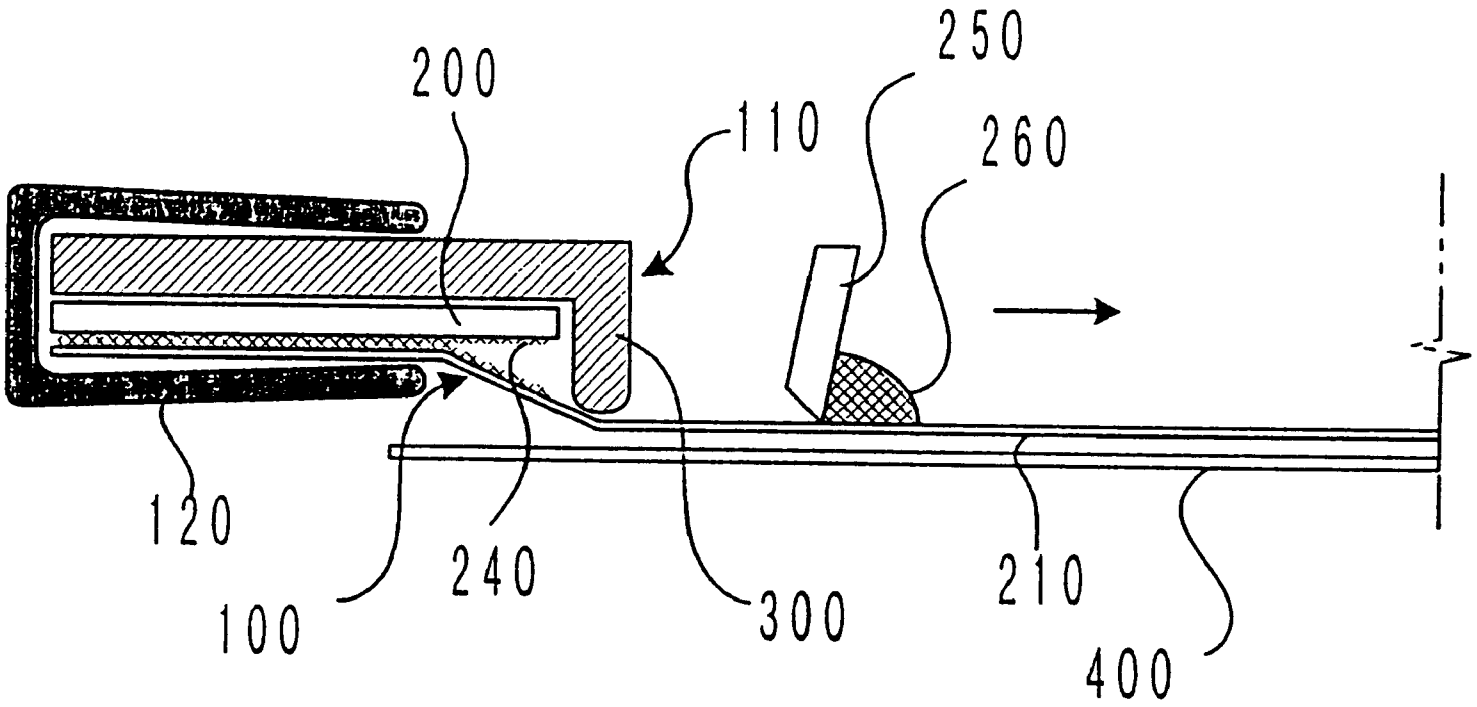
FIG. 7 is the sectional view taken along a cutting line B—B of FIG. 3.

FIG. 1 through FIG. 7 shows an embodiment of the present invention in which FIG. 1 is a disassembled perspective view of a screen printing machine, FIG. 2 is a sectional view thereof, FIG. 3 is an assembled perspective view of the screen printing machine, FIG. 4 is a sectional view thereof, FIG. 5 is a plane view of a stencil sheet assembly, FIG. 6 is a perspective view of a tension frame and FIG. 7 is a sectional view showing operation of the embodiment in FIG. 4.

In FIGS. 1 through 3, numeral 100 designates a stencil sheet assembly. The stencil sheet assembly 100 is constituted by a frame member 200 and stencil sheet 210. The frame member 200 is constituted substantially in a rectangular shape and is provided with outer peripheral sides partitioning an outer configuration and inner peripheral sides partitioning an opening in a substantially rectangular shape. The stencil sheet 210 is constituted by a rectangular shape substantially equal to the outer configuration of the frame member 200. The stencil sheet 210 is adhered, by an adhering agent 240, to one face of the frame member 200 to cover the opening of the frame member 200 and is extended on the opening of the frame member 200.

The stencil sheet 210 is constituted by an ink-permeable substrate and a heat-sensitive resin film adhered thereto. The substrate of the stencil sheet 210 is adhered to the frame member.

In the drawings, numeral 110 designates a tension frame for applying tension to the stencil sheet 210 in a state thereof put on the stencil sheet assembly 100.

The tension frame 110 is substantially in a rectangular shape and its outer configuration is substantially equal to the outer configuration of the frame member 200. However, when the tension frame 110 is put on the stencil sheet assembly 100, the inner peripheral sides of the tension frame 110 are projected to inner sides of the inner peripheral sides of the frame member. Further, at the inner peripheral sides of the tension frame 110, there is formed a raised portion 300 raised toward the stencil sheet 210. Although according to the example, the raised portion 300 is projected in a direction orthogonal to respective surfaces of the tension frame 110 and the perforated stencil sheet assembly 100, this is not necessarily an indispensable condition. In sum, the raised portion 300 may be constituted by a shape projected from the surface of the tension frame 110. Further, it is preferable that a front end of the raised portion 300 is formed in a shape of a curved face such that the stencil sheet 210 is not damaged.

As shown by FIG. 4, the tension frame 110 is put on other face of the frame member 200. The raised portion 300 enters inside of the opening of the frame member 200 and pushes out a peripheral portion of the stencil sheet 210 to thereby apply tension thereto.

In the drawings, numeral 120 designates a pinching piece as holding means for holding peripheral edges of the stencil sheet assembly 100 and the tension frame 110 which are put together. The pinching piece 120 comprises a material having elasticity to some degree such as resin. As shown in FIG. 2, the section is of a channel type and an interval between front ends of two flanges thereof is thinner than a thickness of laminating together the stencil sheet assembly 100 and the tension frame 110. Therefore, the stencil sheet assembly 100 and the tension frame 110 which are put together can be held by elastic force. Further, as shown in FIG. 3, according to the example, four of the pinching pieces 120 respectively hold fours of outer peripheral sides of the stencil sheet assembly 100 and the tension frame 110 which are put together.

Further, the pinching piece 120 may be of any shape so far as the pinching piece 120 can pinch and hold the stencil sheet assembly 100 and the tension frame 110 which are put together and as holding means, a clip or an adhering tape, not illustrated, may be used. Further, although according to the example, only four of the outer peripheral sides of the stencil sheet assembly 100 and the tension frame 110 which are put together are respectively held, the holding operation may be carried out by including corner portions of the stencil sheet assembly 100 and the tension frame 110 which are put together.

Next, an explanation will be given of operation of the embodiment.

First, the stencil sheet 210 of the stencil sheet assembly 100 is perforated. Next, as shown in FIG. 1, other face of the frame member 200 of the stencil sheet assembly 100, that is, a face of the frame member 200 on a side opposed to one face thereof adhered with the stencil sheet 210, and the raised portion 300 of the tension frame 110 are made to be opposed to each other. Further, as shown in FIG. 3, the stencil sheet assembly 100 and the tension frame 110 are put together and the both members are fixed by the pinching pieces 120. Thereby, the screen printing machine according to the example is integrated.

Next, as shown in FIG. 4, the above-described screen printing machine is installed relative to printed matter 400 so that a resin film of the stencil sheet 210 contacts the printed matter 400. Further, ink 260 is placed on a face of the stencil sheet 210 on a side opposed to a face thereof in contact thereof the printed matter 400, that is, an upper face of the substrate. While pressing the stencil sheet 210 by a squeegee 250, the stencil sheet 210 is made to adhere onto the printed matter 400 to thereby carry out squeegeeing operation in an arrow mark direction. The ink 260 passes through perforations of the stencil sheet 210 and is transcribed onto the printed matter 400 to thereby form the printed image.

At this occasion, in the case of the above-described embodiment, as shown in FIG. 7, it is conceivable that there occurs inconvenience in which the stencil sheet 210 adhered to the frame member 200 by the adhering agent 240 is peeled off from the frame member 200 and pertinent tension cannot be applied to the stencil sheet 210.

An explanation will be given of further preferable other embodiments for excluding such a possibility in reference to FIG. 8 through FIG. 16.

Figure 8:
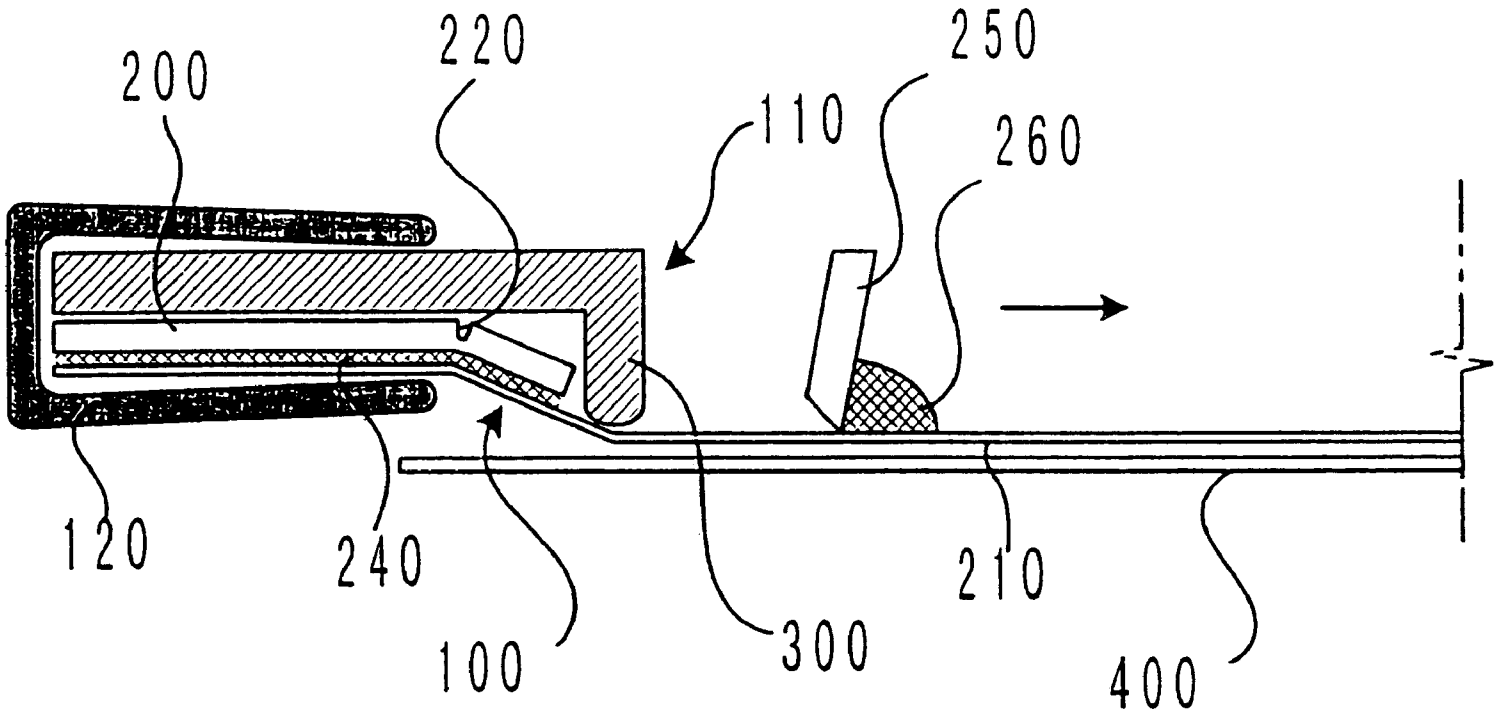
FIG. 8 is the sectional view in the case in which other embodiment of a stencil sheet assembly in comparison with that of FIG. 7 is used in the screen printing machine of the application.
Figure 9:
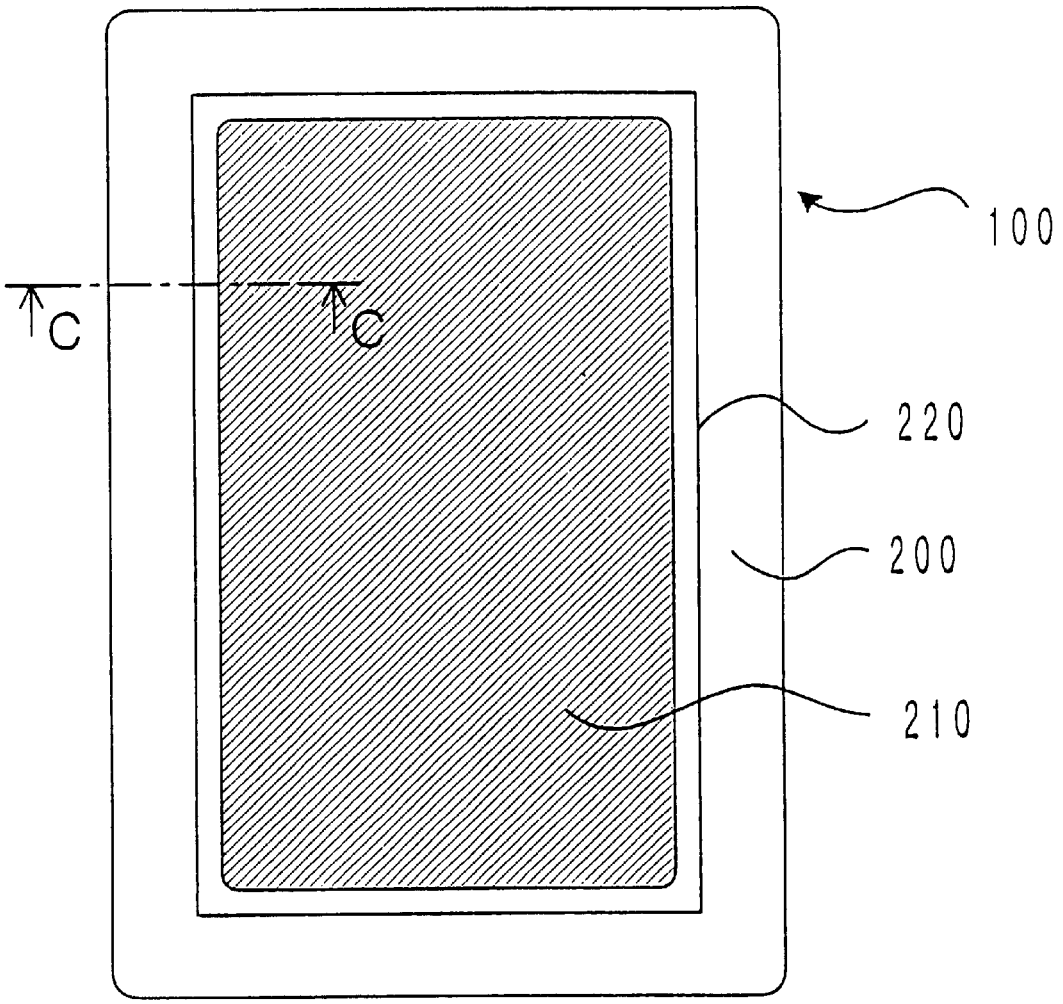
FIG. 9 is a plane view of other embodiment of a stencil sheet assembly according to the present invention.
Figure 10:
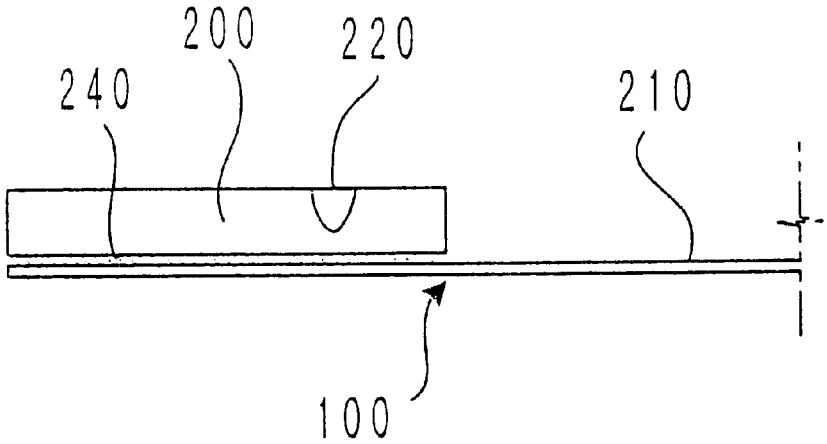
FIG. 10 is a sectional view showing an embodiment of a folding groove portion taken along a cutting line C—C of FIG. 9.
Figure 11:
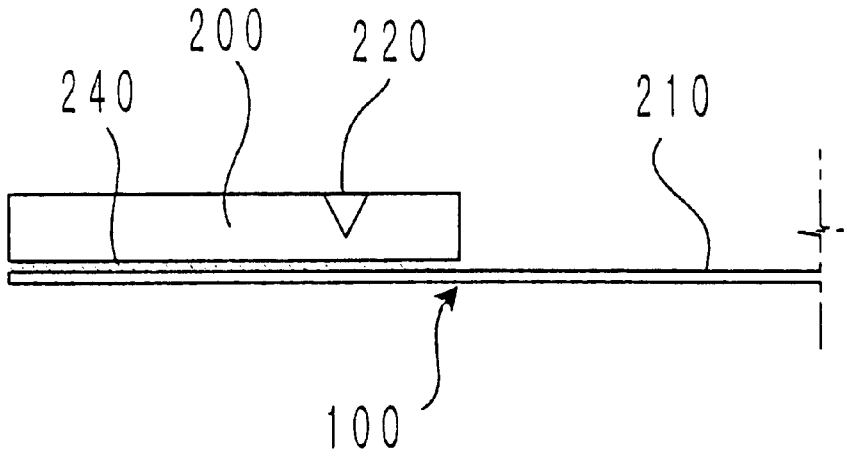
FIG. 11 is a sectional view showing an embodiment of a folding groove portion taken along the cutting line C—C of FIG. 9.
Figure 12:
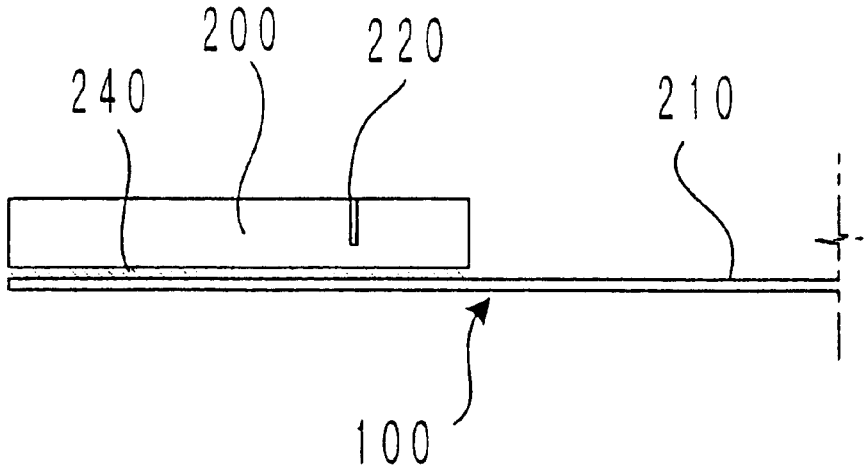
FIG. 12 is a sectional view showing an embodiment of a folding groove portion taken along the cutting line C—C of FIG. 9.
Figure 13:
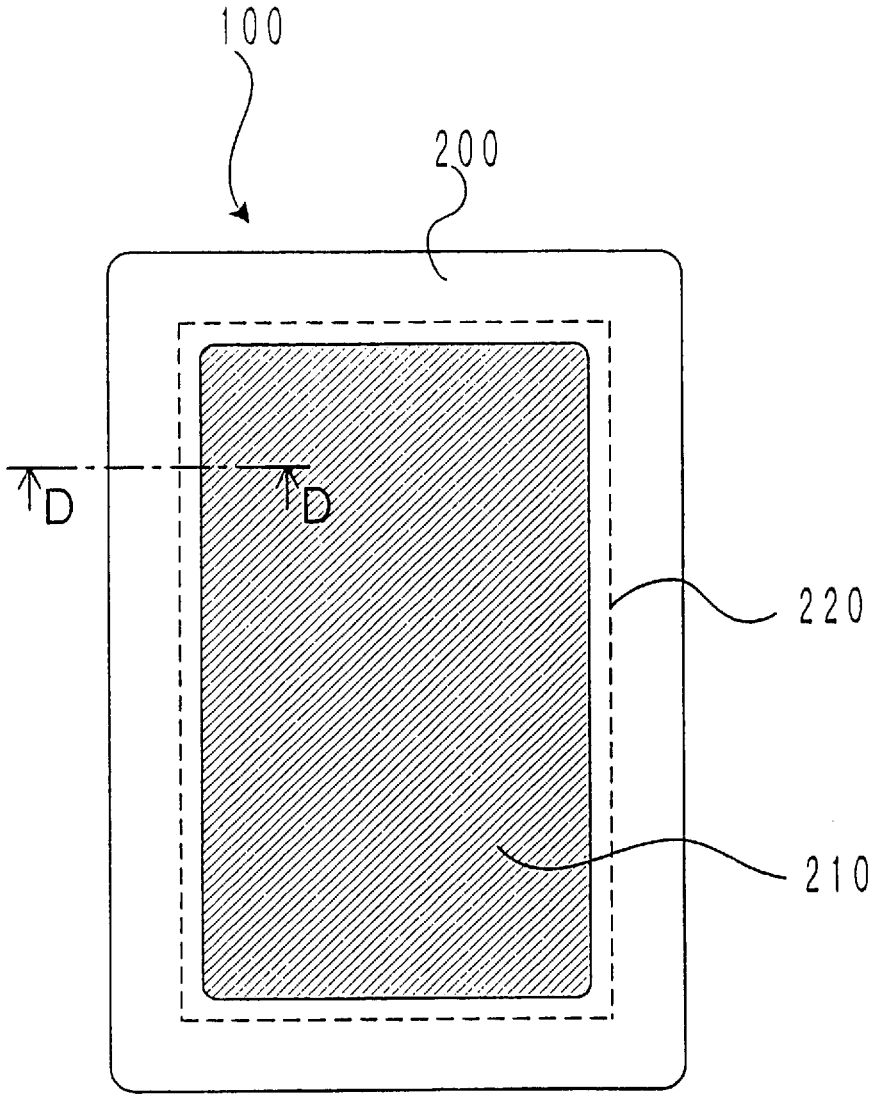
FIG. 13 is a plane view showing other embodiment of a stencil sheet assembly according to the present invention.
Figure 14:
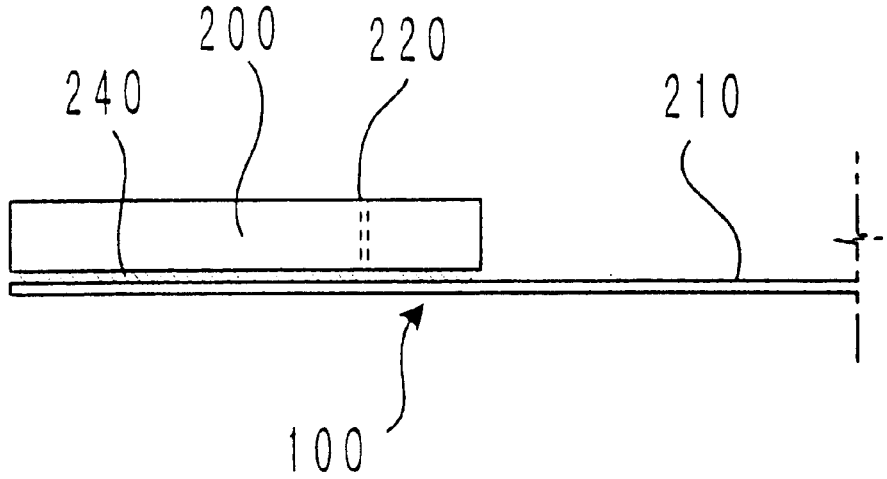
FIG. 14 is a sectional view showing an embodiment of a folding groove portion taken along a cutting line D—D of FIG. 10.
Figure 15:
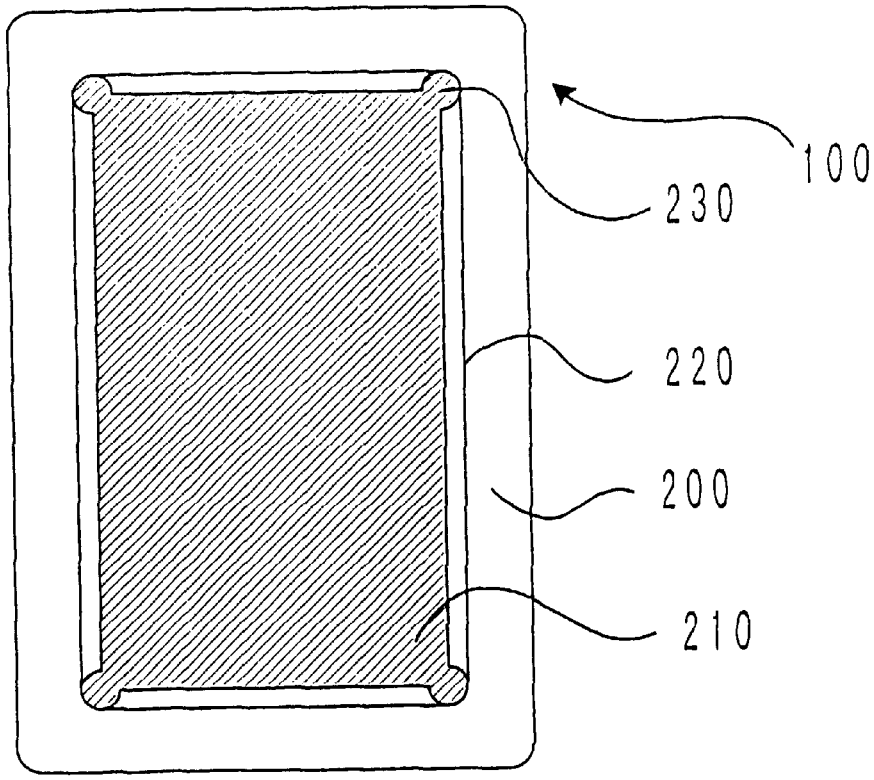
FIG. 15 is a plane view showing an embodiment of a cut-in portion of a stencil sheet assembly according to the present invention.
Figure 16:
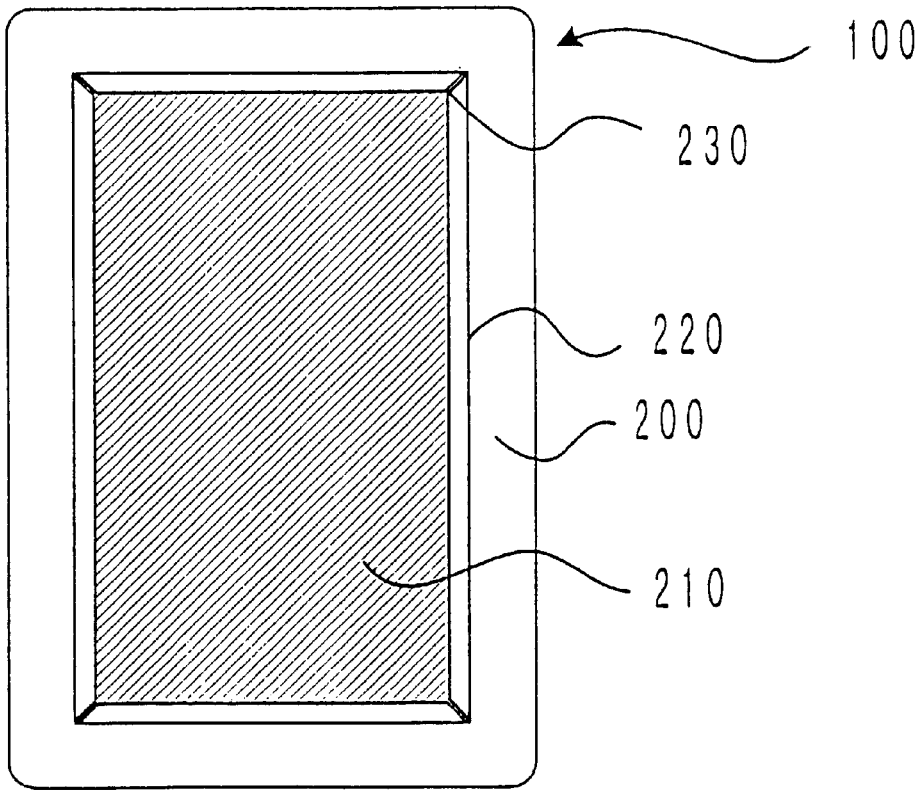
FIG. 16 is a plane view showing an embodiment of a cut-in portion of a stencil sheet assembly according to the present invention.

FIG. 8 is a sectional view in the case in which other embodiment of a stencil sheet assembly is used in a screen printing machine, FIG. 9 is a plane view showing other embodiment of a stencil sheet assembly, FIG. 10 through FIG. 12 are sectional views showing embodiments of folding groove portions of stencil sheet assemblies, FIG. 13 is a plane view showing an embodiment of a folding groove portion of a stencil sheet assembly, FIG. 14 is a sectional view thereof and FIG. 15 and FIG. 16 are plane views showing embodiments of cut-in portions of stencil sheet assemblies.

As shown in FIG. 8 and FIG. 9, the frame member 200 of the stencil sheet assembly 100 is formed with a folding groove portion 220 on other face of the frame member 200 on a side opposed to one face thereof adhered with the stencil sheet 210. The folding groove portion 220 is in parallel with the outer peripheral sides and the inner peripheral sides of the frame member 200 and is formed to surround the opening of the frame member 200.

Further, examples of structures of the folding groove portions 220 are shown in FIG. 10, FIG. 11 and FIG. 12.

These are half-cut grooves or grooves by mold press which do not penetrate the frame member 200 in the thickness direction.

The folding groove portion 220 is requested to be constituted by a structure satisfying following functions. First, when the stencil sheet assembly 100 is integrated, it is necessary that the frame member 200 can easily be folded with the folding groove portion 220 as a boundary. Next, in a state in which the stencil sheet assembly 100 is integrated and the frame member 200 is folded, it is necessary that the frame member 200 is not destructed at the folding groove portion 220 by being pulled by the stencil sheet 210. That is, it is necessary that the folding groove portion 220 of the frame member 200 is provided with sufficient tensile strength with respect to a radial line direction from center of the stencil sheet assembly 100. When there is constructed a structure satisfying such conditions, any structure other than the structures, mentioned above, may be used.

Further, under the above-described conditions, the folding groove portion 220 may not be formed by a continuous groove but may be formed by a structure of perforations as formed by a sewing machine shown in FIG. 13. Further, as shown in FIG. 14 indicating a section D—D of FIG. 13, only the folding groove portion 220 which is intermittent as in perforations as formed by a sewing machine, may not be constituted by a half-cut groove but may penetrate the frame member 200.

Next, as shown in FIG. 15 and FIG. 16, cut-in portions 230 may be provided at four corners of the inner peripheral sides of the frame member 200 of the stencil sheet assembly 100. When the cut-in portions 230 are provided in this way, when integrating the stencil sheet assembly 100 and the tension frame 110, a force of folding the frame member 200 at the folding groove portion 220 may be reduced, further, the frame member 200 and the stencil sheet 210 are less damaged. Further, a cut-in length of the cut-in portion 230 needs a distance up to an intersecting point of contiguous ones of the folding groove portions 220 intersecting substantially orthogonally. Further, the cut-in portion 230 may be of any shape.

According to the screen printing machine of the present invention, by a simple structure of only holding the tension frame to the stencil sheet assembly by the pinching pieces, pertinent tension can be applied to the stencil sheet. Therefore, the printing operation can be carried out firmly and easily. Further, when the folding groove portion is provided to the frame member of the stencil sheet assembly, in the case in which tension is to applied to the stencil sheet by the tension frame, there can be prevented destruction by peeling off of the stencil sheet and the frame member constituting the stencil sheet assembly and the stencil sheet can be applied with tension which is always pertinent and stable.

What is claimed is:

1. A stencil sheet assembly comprising:

a frame member having outer peripheral sides for partitioning an outer configuration and inner peripheral sides for partitioning an opening;

stencil sheet adhered to one face of the frame member to cover the opening; and at least one folding groove portion formed on other face of the frame member and in parallel with the inner peripheral sides of the frame member.

2. The stencil sheet assembly according to claim 1:

wherein the frame member is a frame member substantially in a rectangular shape having four of the outer peripheral sides and four of the inner peripheral sides and the opening substantially in a rectangular shape;

wherein the folding groove portion comprises four of folding groove portions formed along the four inner peripheral sides; and wherein four corners of the inner peripheral sides of the frame member are formed with cut-in portions reaching intersecting points of the folding groove portions orthogonally intersecting with each other and contiguous to each other.

* * * * *